US006683513B2

(12) United States Patent
Shamsaifar et al.

(10) Patent No.: US 6,683,513 B2
(45) **Date of Patent: *Jan. 27, 2004**

(54) ELECTRONICALLY TUNABLE RF DIPLEXERS TUNED BY TUNABLE CAPACITORS

(75) Inventors: Khosro Shamsaifar, Ellicott City, MD (US); Jian Xu, Clarksville, MD (US)

(73) Assignee: Paratek Microwave, Inc., Columbia, MD (US)

( * ) Notice: Subject to any disclaimer, the term of this patent is extended or adjusted under 35 U.S.C. 154(b) by 27 days.

This patent is subject to a terminal disclaimer.

(21) Appl. No.: 10/000,471

(22) Filed: Oct. 24, 2001

(65) Prior Publication Data

US 2002/0053954 A1 May 9, 2002

Related U.S. Application Data

(60) Provisional application No. 60/243,962, filed on Oct. 26, 2000.

(51) Int. Cl.[7] ..... H01P 1/213

(52) U.S. Cl. ..... 333/135; 333/209

(58) Field of Search ..... 333/135, 209, 333/202, 132, 134, 205, 208

(56) References Cited

U.S. PATENT DOCUMENTS

| | | | |
|---|---|---|---|
| 4,456,895 | A | 6/1984 | Landt et al. |
| 4,761,625 | A | 8/1988 | Sharma |
| 4,990,870 | A | 2/1991 | Reindel |
| 4,990,871 | A | 2/1991 | Reindel |
| 5,065,453 | A | 11/1991 | Thomas |
| 5,070,313 | A | 12/1991 | Gladh et al. |
| 5,227,748 | A | 7/1993 | Sroka |
| 5,267,234 | A | 11/1993 | Harrison |
| 5,427,988 | A | 6/1995 | Sengupta et al. |
| 5,515,017 | A | 5/1996 | Yamada et al. |

(List continued on next page.)

FOREIGN PATENT DOCUMENTS

| | | | |
|---|---|---|---|
| EP | 0 843 374 A2 | 5/1998 | |
| EP | 0 881 700 A1 | 12/1998 | |
| EP | 0980109 A2 * | 2/2000 | ..... H01P/1/15 |
| JP | 63009303 | 1/1988 | |
| JP | 06061705 | 3/1994 | |
| JP | 10135708 | 5/1998 | |
| WO | WO 00/35042 | 6/2000 | |

OTHER PUBLICATIONS

PCT International Search Report for International Application No. PCT/US01/51363 dated May 31, 2002.

Keis V.N. et al. "20 GHz Tunable Filter Based on Ferroelectric (Ba,Sr)$TiO_3$ Film Varactors", Electronics Letters, vol. 34, No. 11, 2 pages, May 28, 1998.

Vendik O.G. et al. "Ferroelectric Tuning of Planar and Bulk Microwave Devices", Journal of Superconductivity, vol. 12, No. 2, pp. 325–338, 1999.

(List continued on next page.)

*Primary Examiner*—Robert Pascal
*Assistant Examiner*—Dean Takaoka
(74) *Attorney, Agent, or Firm*—Robert P. Lenart; James S. Finn

(57) ABSTRACT

A diplexer includes a first tunable bandpass filter connected to a first port, a second tunable bandpass filter connected to a second port, and a coupling element for coupling the first bandpass filter and the second bandpass filter to a third port. Each of the tunable bandpass filters includes a tunable capacitor, wherein a control signal applied to the tunable capacitor controls the transmission characteristic of the filter. The tunable capacitor can be a tunable dielectric varactor or a microelectromechanical variable capacitor. The coupling element can include one of: a circulator, a T-junction, and an orthomode transducer. Each of the first and second filters can comprise a fin line filter including a plurality of tunable dielectric capacitors mounted within a waveguide for controlling the filter transmission characteristics. Fixed bandpass filters can be inserted between each of the tunable bandpass filters and the coupling element.

18 Claims, 7 Drawing Sheets

U.S. PATENT DOCUMENTS

| | | | | | |
|---|---|---|---|---|---|
| 5,543,764 | A | | 8/1996 | Turunen et al. | |
| 5,578,976 | A | | 11/1996 | Yao | 333/262 |
| 5,594,395 | A | | 1/1997 | Niiranen | |
| 5,627,502 | A | | 5/1997 | Ervasti | |
| 5,635,433 | A | | 6/1997 | Sengupta | |
| 5,635,434 | A | | 6/1997 | Sengupta | |
| 5,693,429 | A | | 12/1997 | Sengupta et al. | |
| 5,766,697 | A | | 6/1998 | Sengupta et al. | |
| 5,830,591 | A | | 11/1998 | Sengupta et al. | |
| 5,846,893 | A | | 12/1998 | Sengupta et al. | |
| 5,953,644 | A | | 9/1999 | Kool et al. | |
| 5,963,856 | A | | 10/1999 | Kim | |
| 5,986,520 | A | * | 11/1999 | Abeno et al. | 333/134 |
| 6,018,282 | A | * | 1/2000 | Tsuda | 333/205 |
| 6,072,994 | A | * | 6/2000 | Phillips et al. | 455/84 |
| 6,074,971 | A | | 6/2000 | Chiu et al. | |
| 6,085,071 | A | | 7/2000 | Yamada et al. | |
| 6,133,810 | A | | 10/2000 | Shockley | |
| 6,308,085 | B1 | * | 10/2001 | Shoki | 455/562 |
| 6,492,883 | B2 | * | 12/2002 | Liang et al. | 333/132 |
| 2002/0140527 | A1 | * | 10/2002 | Shamsaifar et al. | 333/202 |
| 2002/0163400 | A1 | * | 11/2002 | Toncich | 333/125 |
| 2002/0183013 | A1 | * | 12/2002 | Auckland et al. | 455/73 |
| 2003/0001692 | A1 | * | 1/2003 | Chiu et al. | 333/164 |

OTHER PUBLICATIONS

Miranda F.A. et al. "A K–Band (HTS, Gold0/Ferroelectric Thin Film/Dielectric Diplexer for a Discriminator–Locked Tunable Oscillator", IEEE Transactions on Applied Superconductivity, vol. 9, No. 2, pp. 3581–3584, Jun. 1999.

U.S. patent application Ser. No. 09/419,126, Sengupta et al., filed Oct. 15, 1999.

U.S. patent application Ser. No. 09/594,837, Chiu et al., filed Jun. 15, 2000.

U.S. patent application Ser. No. 09/704,850, Zhu et al., filed Nov. 2, 2000.

U.S. patent application Ser. No. 09/768,690, Sengupta et al., filed Jan. 24, 2001.

U.S. patent application Ser. No. 09/834,327, Chang, filed Apr. 13, 2001.

U.S. patent application Ser. No. 09/882,605, Sengupta, filed Jun. 15, 2001.

U.S. patent application Ser. No. 60/295,046, Luna et al., filed Jun. 1, 2001.

J. Xu et al, "Full Wave Analysis and Design of the RF Tunable Filter," *IEEE MTT–S, 2001 International Microwave Symposium Digest*, vol. 3, May 2001, pp. 1449–1452.

* cited by examiner

ELECTRONICALLY TUNABLE RF DIPLEXERS TUNED BY TUNABLE CAPACITORS

CROSS REFERENCE TO A RELATED APPLICATION

This application claims the benefit of U.S. Provisional Application Ser. No. 60/243,962, filed Oct. 26, 2000.

FIELD OF INVENTION

The present invention generally relates to electronic diplexers, and more particularly to tunable diplexers.

BACKGROUND OF INVENTION

Commercially available radio frequency (RF) diplexers include two fixed bandpass filters sharing a common port (antenna port) through a circulator or a T-junction. Signals applied to the antenna port are coupled to a receiver port through the receive bandpass filter, and signals applied to a transmitter port will reach the antenna port through a transmit filter. The receive port and transmitter port are isolated from each other due to the presence of the filters and the circulator, or T-junction. In another configuration, the receive signals reaching the antenna will be divided into two sub-bands according to the band pass frequencies of the filters. In the opposite direction, two signals reaching the non-common ports of the filters will be combined and output at the common port. Also in this configuration the two filters are isolated with respect to each other.

Fixed diplexers are commonly used in point-to-point and point-to-multipoint radios where two-way communication enables voice, video and data traffic within the RF frequency range. Fixed diplexers need to be wide band so that their count does not exceed reasonable numbers to cover the desired frequency plan.

It would be desirable to have a tunable diplexer that would could be used to replace fixed diplexers in receivers. A single tunable diplexer solution would enable radio manufacturers to replace several fixed diplexers covering adjacent frequencies. This versatility can provide front end RF tunability in real time applications and decrease deployment and maintenance costs through software controls and reduced component count.

SUMMARY OF THE INVENTION

Diplexers constructed in accordance with this invention include a first tunable bandpass filter connected to a first port, a second tunable bandpass filter connected to a second port, and a coupling element for coupling the first bandpass filter and the second bandpass filter to a third port. Each of the tunable bandpass filters includes at least one tunable capacitor, wherein a control signal applied to the tunable capacitor controls the transmission characteristic of the filter. The tunable capacitor can be a tunable dielectric varactor or a microelectromechanical variable capacitor. The coupling element can include one of: a circulator, a T-junction, and an orthomode transducer. Each of the first and second filters can comprise a fin line filter including a plurality of tunable dielectric capacitors mounted within a waveguide for controlling the filter transmission characteristics. Fixed bandpass filters can be inserted between each of the tunable bandpass filters and the coupling element.

DETAILED DESCRIPTION OF THE INVENTION

The present invention provides tunable diplexers having low insertion loss, fast tuning speed, high power-handling capability, high IP3 and low cost in the microwave frequency range.

Figure 1:
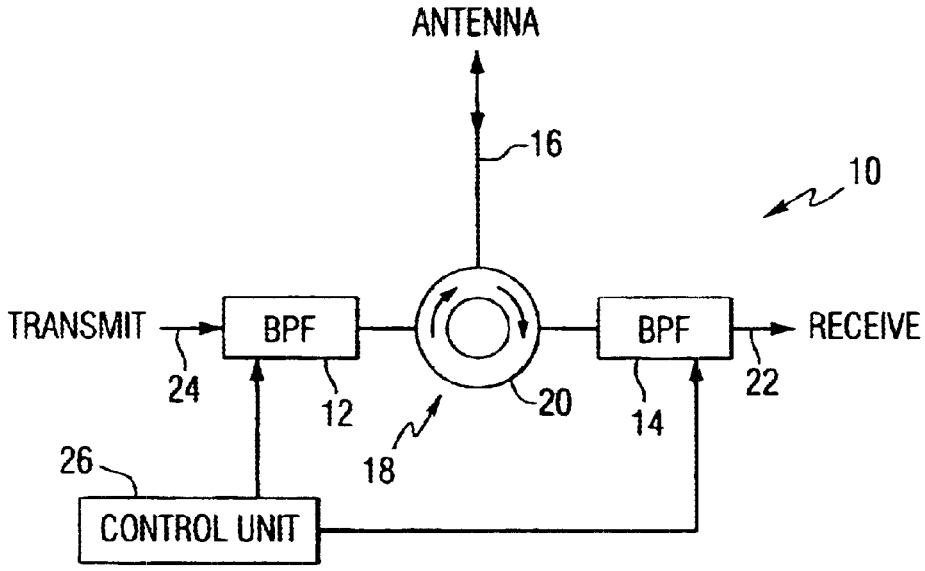
FIG. 1 is a schematic representation of a tunable diplexer constructed in accordance with this invention.

Referring to the drawings, FIG. 1 is a schematic representation of a tunable diplexer 10 constructed in accordance with this invention. The tunable diplexer 10 includes two electronically tunable bandpass filters 12 and 14 connected to a common port 16 through a coupling means 18. In the embodiment of FIG. 1, the coupling means is a circulator 20. Filter 12 is a receive filter connected to couple signals from the coupling means to a first (receive) port 22. Filter 14 is a transmit filter connected to couple signals from the coupling means to a second (transmit) port 24. Filters 12 and 14 are tunable bandpass filters. In the preferred embodiment, the filters include tunable dielectric varactors that can be rapidly tuned and are used to control the transmission characteristics of the filters. Alternatively, microelectromechanical (MEM) variable capacitors can be used in the tunable filters. A control unit 26, which can be a computer or other processor, is used to supply a control signal to tunable capacitors in the filters, preferably through high impedance control lines. The control unit can use an open loop or closed loop control technique. Various types of tunable filters can be used in the diplexers of this invention. The circulator 20 of FIG. 1 achieves isolation between the two filters.

Figure 2:
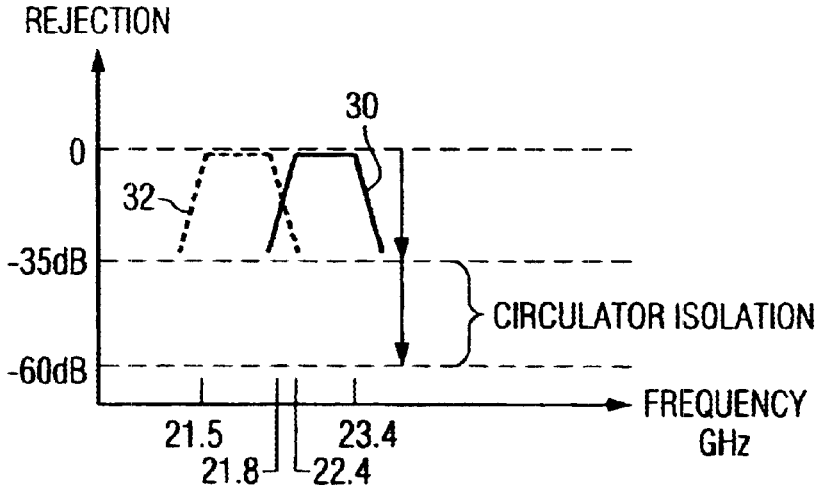
FIG. 2 is a graph of the frequency response of one of the filters of the diplexer of FIG. 1.

FIG. 2 is a graph of the frequency response of one of the filters of the diplexer of FIG. 1. The circulator provides −25 dB of isolation 28. Curve 30 represents the filter passband when tunable dielectric varactors in the filters are biased at a first level, which can be zero volts, and curve 32 represents the filter passband when the varactors are biased at a second level, such as 300 volts. The control unit can be used to control the bias voltage on varactors in the filters and thereby control the passband of the filters.

Figure 3:
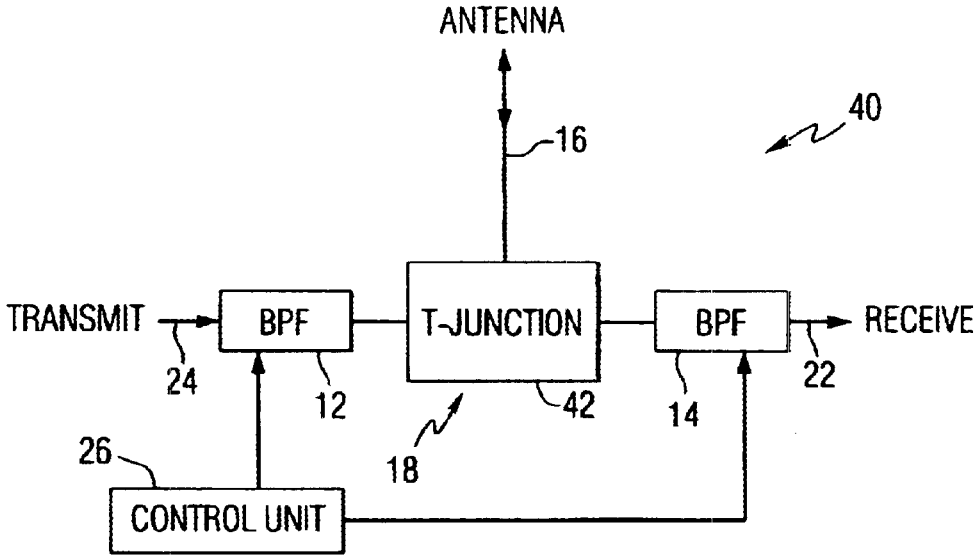
FIG. 3 is a schematic representation of another tunable diplexer constructed in accordance with this invention.

FIG. 3 is a schematic representation of another tunable diplexer 40 constructed in accordance with this invention. Diplexer 40 uses a T-junction 42 as the coupling element 18.

Figure 4:
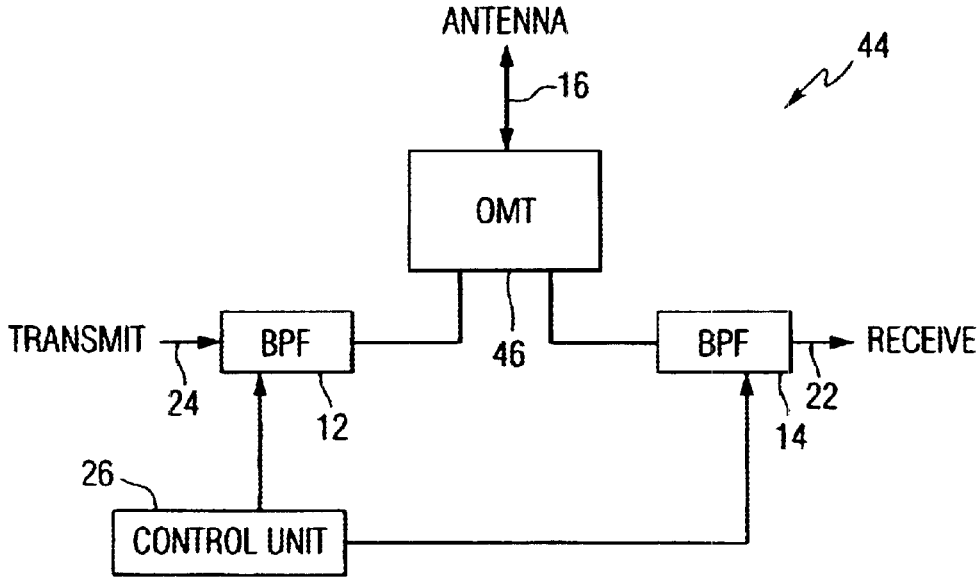
FIG. 4 is a schematic representation of another tunable diplexer constructed in accordance with this invention.

FIG. 4 is a schematic representation of another tunable diplexer 44 constructed in accordance with this invention. Diplexer 44 uses an Ortho-Mode Transducer (OMT) 46 as the coupling element 18.

Figure 5:
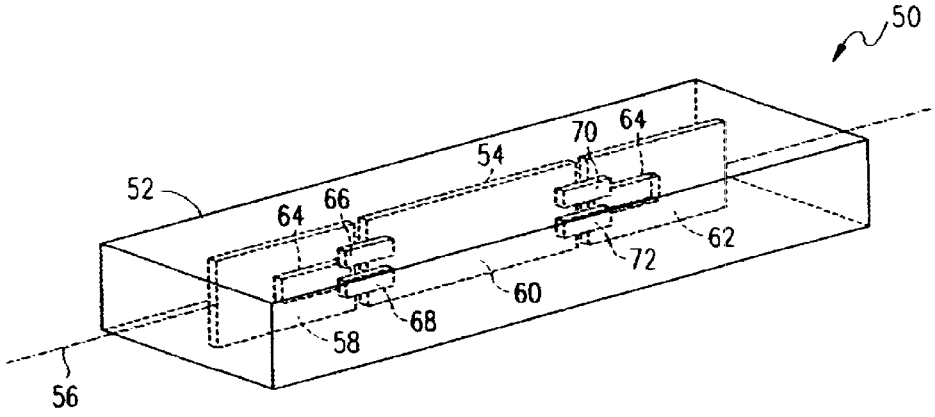
FIG. 5 is a schematic representation of a filter that can be used in the diplexers of FIGS. 1, 3 or 4.

One possible structure for the filters is a fin line filter, which includes a rectangular waveguide cut in two halves according to the E-plane, plus an e-plane metal septum. FIG. 5 is a schematic representation of a two-pole fin line filter 50 that can be used in the diplexers of FIGS. 1, 3 or 4. The filter includes a rectangular waveguide 52 and a septum 54 mounted along an axis 56 of the waveguide. The septum is divided into three sections 58, 60 and 62. A longitudinal slot 64 passes into each of the other sections. Tunable capacitors 66, 68, 70 and 72 are mounted across the gaps in the septum. The tunable capacitors can be microelectromechanical variable capacitors or tunable dielectric varactors. By applying a tuning voltage to the varactors, the passband of the filter can be changed.

Figure 6:
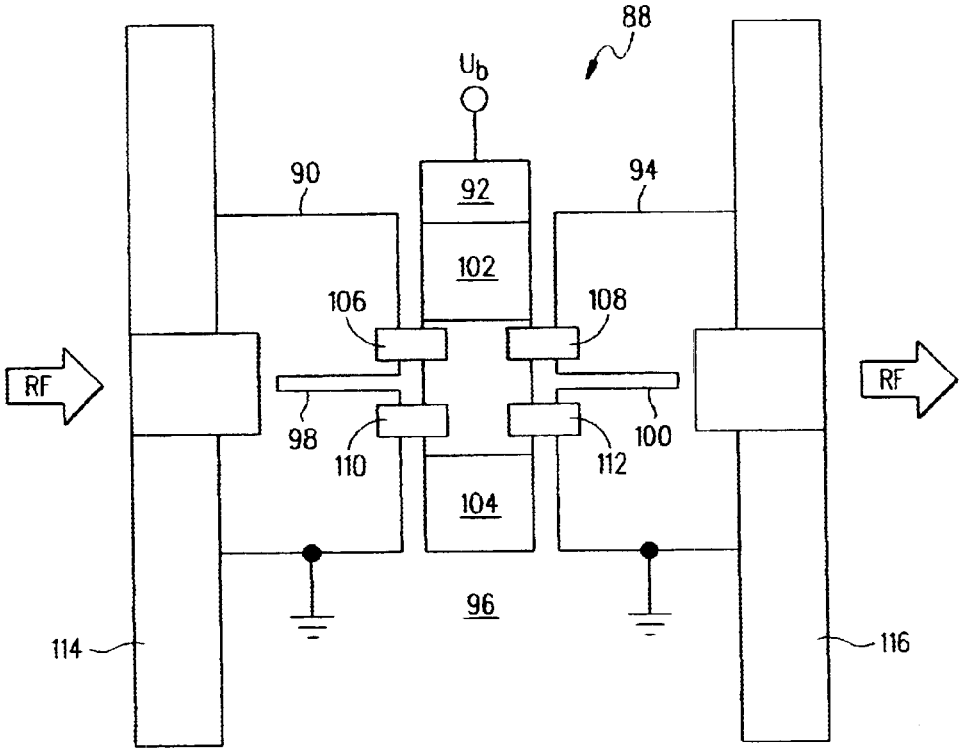
FIG. 6 (PRIOR ART)
FIG. 6 is a cross sectional view of another fin line filter that can be used in the diplexers of FIGS. 1, 3 or 4.

FIG. 6 is a cross sectional view of another tunable fin line filter 88 that can be used in the diplexers of FIGS. 1, 3 or 4. The filter 88 includes four tunable dielectric varactors on a symmetrical fin line in a rectangular waveguide. An electrically tunable filter is achieved at room temperature by mounting several tunable dielectric varactors on a fin line waveguide. The fin line construction is comprised of three foil copper plates 90, 92 and 94 with thickness of 0.2 mm placed at the center of the waveguide 96 along its longitudinal axis. Two lateral plates with shorted end fin line resonators 98 and 100 are grounded due to the contact with the waveguide. Central plate 92 is insulated for DC voltage from the waveguide by mica 102 and 104 and is used to apply the control voltage to the tunable capacitors 106, 108, 110 and 112. The tunable dielectric varactors are soldered in the end of the fin line resonators between plates 90 and 92, and plates 94 and 92. Flanges 114 and 116 support the plates.

Figure 7:
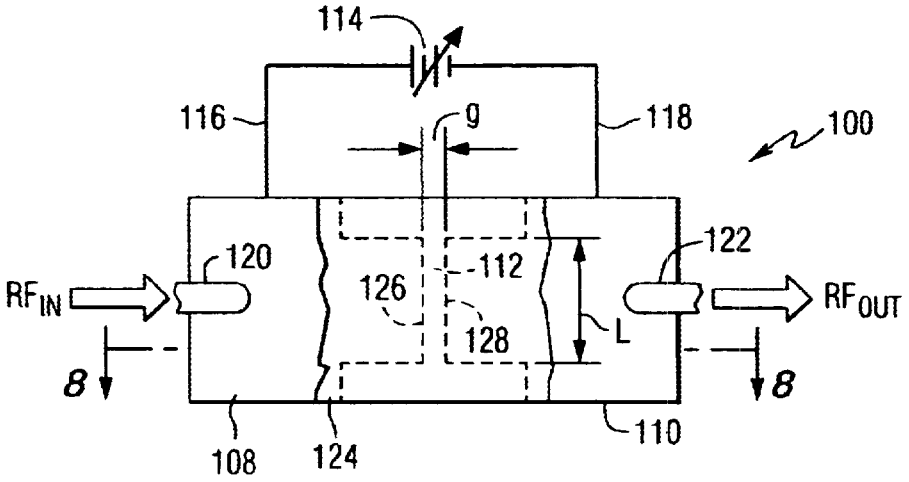
FIG. 7 is a top view of a tunable dielectric capacitor that can be used in the filter of FIG. 5 or 6.
Figure 8:
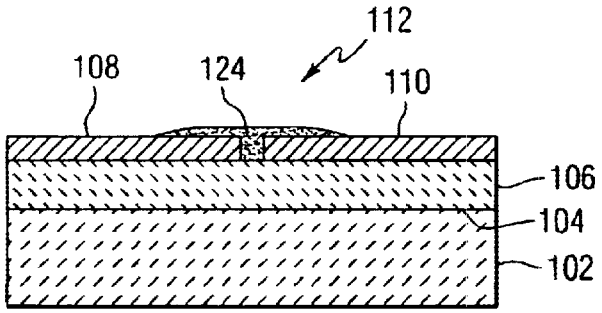
FIG. 8 is a cross-sectional view of the tunable dielectric capacitor of FIG. 7 taken along line 8—8.

FIGS. 7 and 8 are top and cross sectional views of a tunable dielectric varactor 100 that can be used in the tunable bandpass filters of this invention. The varactor 100 includes a substrate 102 having a generally planar top surface 104. A tunable dielectric layer 106 is positioned adjacent to the top surface of the substrate. A pair of metal electrodes 108 and 110 are positioned on top of the ferroelectric layer. The substrate 102 is comprised of a material having a relatively low permittivity such as MgO, Alumina, $LaAlO_3$, Sapphire, or a ceramic. For the purposes of this description, a low permittivity is a permittivity of less than about 30. The tunable dielectric layer 106 is comprised of a material having a permittivity in a range from about 20 to about 2000, and having a tunability in the range from about 10% to about 80% at a bias voltage of about 10 V/$\mu$m. In the preferred embodiment this layer is preferably comprised of Barium-Strontium Titanate, $Ba_xSr_{1-x}TiO_3$ (BSTO), where x can range from zero to one, or BSTO-composite ceramics. Examples of such BSTO composites include, but are not limited to: BSTO-MgO, BSTO-$MgAl_2O_4$, BSTO-$CaTiO_3$, BSTO-$MgTiO_3$, BSTO-$MgSrZrTiO_6$, and combinations thereof. The tunable layer in one preferred embodiment has a dielectric permittivity greater than 100 when subjected to typical DC bias voltages, for example, voltages ranging from about 5 volts to about 300 volts. A gap 112 of width g, is formed between the electrodes 108 and 110. The gap width must be optimized to increase ratio of the maximum capacitance $C_{max}$ to the minimum capacitance $C_{min}$ ($C_{max}/C_{min}$) and increase the quality facto (Q) of the device. The optimal width, g, will be determined by the width at which the device has maximum $C_{max}/C_{min}$ and minimal loss tangent.

A controllable voltage source 114 is connected by lines 116 and 118 to electrodes 108 and 110. This voltage source is used to supply a DC bias voltage to the tunable dielectric layer, thereby controlling the permittivity of the layer. The varactor also includes an RF input 120 and an RF output 122. The RF input and output are connected to electrodes 108 and 110, respectively, by soldered or bonded connections.

In the preferred embodiments, the varactors may use gap widths of less than 5–50 $\mu$m. The thickness of the tunable dielectric layer ranges from about 0.1 $\mu$m to about 20 $\mu$m. A sealant 124 can be positioned within the gap and can be any non-conducting material with a high dielectric breakdown strength to allow the application of high voltage without arcing across the gap. In one embodiment, the sealant can be epoxy or polyurethane.

The other dimension that strongly influences the design of the varactors is the length, L, of the gap as shown in FIG. 7. The length of the gap L can be adjusted by changing the length of the ends 126 and 128 of the electrodes. Variations in the length have a strong effect on the capacitance of the varactor. The gap length will optimized for this parameter. Once the gap width has been selected, the capacitance becomes a linear function of the length L. For a desired capacitance, the length L can be determined experimentally, or through computer simulation.

The electrodes may be fabricated in any geometry or shape containing a gap of predetermined width. The required current for manipulation of the capacitance of the varactors disclosed in this invention is typically less than 1 $\mu$A. In the preferred embodiment, the electrode material is gold. However, other conductors such as copper, silver or aluminum, may also be used. Gold is resistant to corrosion and can be readily bonded to the RF input and output. Copper provides high conductivity, and would typically be coated with gold for bonding or nickel for soldering.

FIGS. 7 and 8 show a voltage tunable planar varactor having a planar electrode with a predetermined gap distance on a single layer tunable bulk, thick film or thin film dielectric. The applied voltage produces an electric field across the gap of the tunable dielectric that produces an overall change in the capacitance of the varactor. The width of the gap can range from 5 to 50 $\mu$m depending on the performance requirements.

By employing the diplexer topology of this invention, a diplexer with receive frequency of, for example, 21.186 GHz and transmit frequency of 22.356 GHz at zero DC field could be tuned to receive frequency of 21.732 GHz and transmit frequency of 22.887 GHz at a bias electric field of 15 V/$\mu$m. All other frequencies between these two values can be covered by applying an electric field strength of 0 to 15 V/$\mu$m.

Additional description of the fin line filter of FIG. 6 and the tunable dielectric varactor of FIGS. 7 and 8, can be found in U.S. patent application Ser. No. 09/419,126, filed Oct. 15, 1999, which is hereby incorporated by reference.

Figure 9:
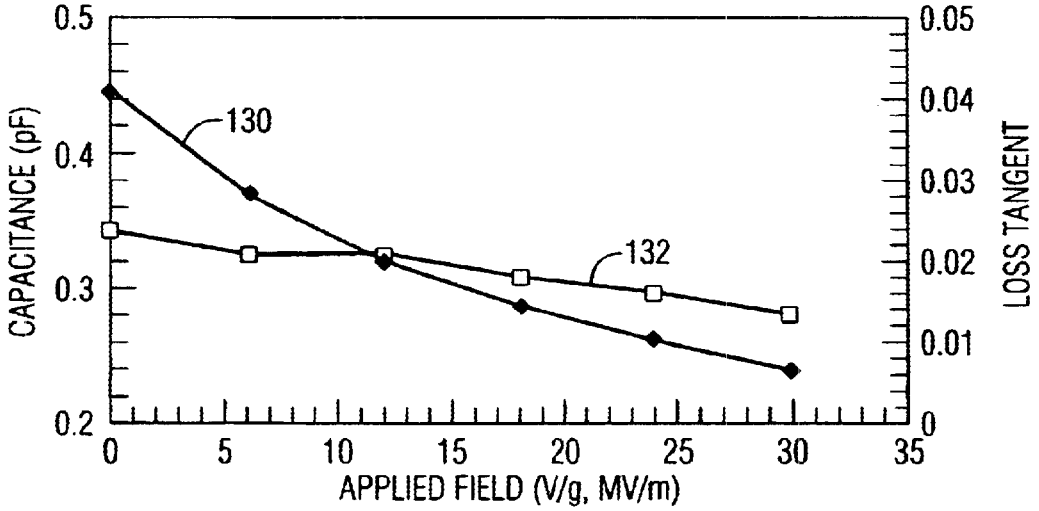
FIG. 9 is a graph illustrating the properties of the tunable dielectric capacitor of FIGS. 7 and 8.

FIG. 9 shows an example of the capacitance 130 and the loss tangent 132 of a tunable dielectric varactor. By applying voltage to the varactor its capacitance value changes and consequently the frequency of the diplexer will be varied.

Figure 10:
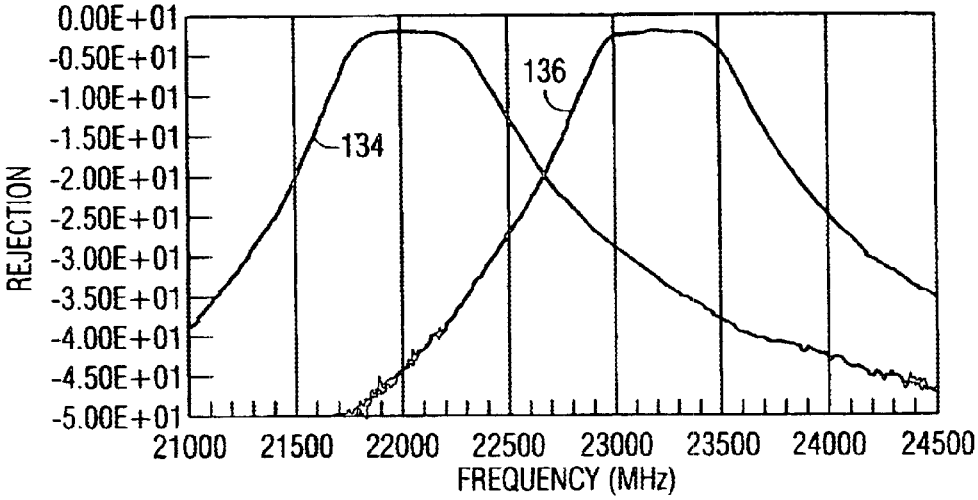
FIG. 10 is a graph illustrating the frequency response of an electronically tunable diplexer constructed in accordance with this invention for operation in the K-band with overall unloaded Q of 450 under zero bias conditions.
Figure 11:
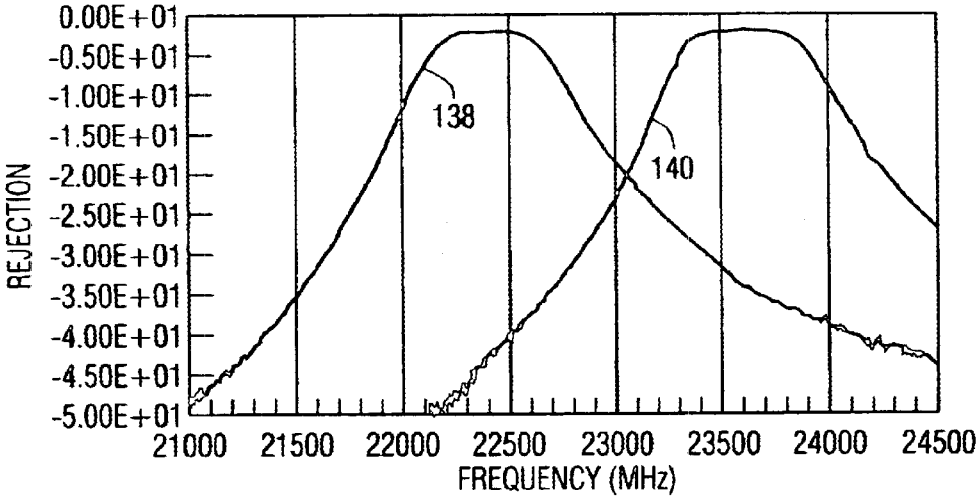
FIG. 11 is a graph illustrating the frequency response of an electronically tunable diplexer constructed in accordance with this invention for operation in K-band with overall unloaded Q of 400 under full bias conditions.

FIGS. 10 and 11 show measured frequency responses of the tunable diplexer with different bias voltages on the tunable dielectric varactors. Curves 134 and 136 of FIG. 10 illustrate an example frequency response of one of the tunable filters having tunable dielectric varactors operated at different varactor control voltages. Curves 138 and 140 of FIG. 10 illustrate an example frequency response of another one of the tunable filters having tunable dielectric varactors operated at different varactor control voltages. It is observed that with this structure a tunability of about 540 MHz is achieved without a considerable degradation of the diplexer response.

While a fin line filter has been described, other structures for the filter, such as iris coupled or inductive post coupled waveguide cavity filters, or filters based on dielectric resonator cavities, or other resonators such as lumped element LC circuits, or planar structure resonators such as microstrip, stripline or coplanar resonators, etc. can be used in the diplexers of this invention. Variation of the capacitance of the tunable dielectric varactors in the tunable filters affects the resonant frequency of filter sections, and therefore affects the passband of the filters. Inherent in every electronically tunable radio frequency filter is the ability to rapidly tune the response using high-impedance control lines. Tunable dielectric materials technology enables these tuning properties, as well as, high Q values, low losses and extremely high IP3 characteristics, even at high frequencies.

Figure 12:
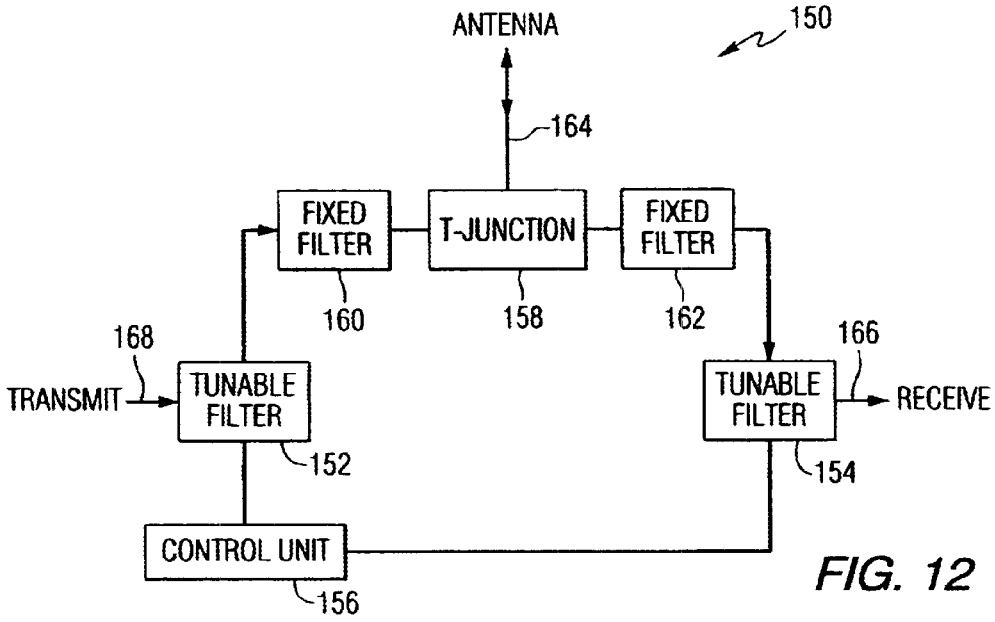
FIG. 12 is a schematic representation of another tunable diplexer constructed in accordance with this invention.

When using the T-junction, the required isolation between transmit and receive will be provided by the filters, which will need a large number of poles in many practical applications. Obviously, a large number of poles means a large insertion loss. In order to reduce insertion loss while maintaining the necessary isolation, fixed bandpass filters can be inserted between the tunable filters and the coupling element. FIG. 12 is a schematic representation of another tunable diplexer constructed in accordance with this invention that includes fixed bandpass filters.

FIG. 12 is a schematic representation of a tunable diplexer 150 constructed in accordance with this invention. The tunable diplexer 150 includes two electronically tunable bandpass filters 152 and 154 having bandpass characteristics that can be varied by applying a control signal from the control unit 156 to tunable capacitors in the filters. A coupling element in the form of a T-junction 158 receives signals from a fixed bandpass filter 160 that is connected the tunable filter 158, and passes signals to a fixed filter 162 that is connected the tunable filter 154. An antenna can be connected to the T-junction through line 164. Tunable filter 154 passes received signals to a receiver on line 166. Tunable filter 152 receives signals to be transmitted on line 168. The filters can include tunable dielectric varactors or MEMS tunable capacitors that can be rapidly tuned and are used to control the transmission characteristics of the filters.

Figure 13:
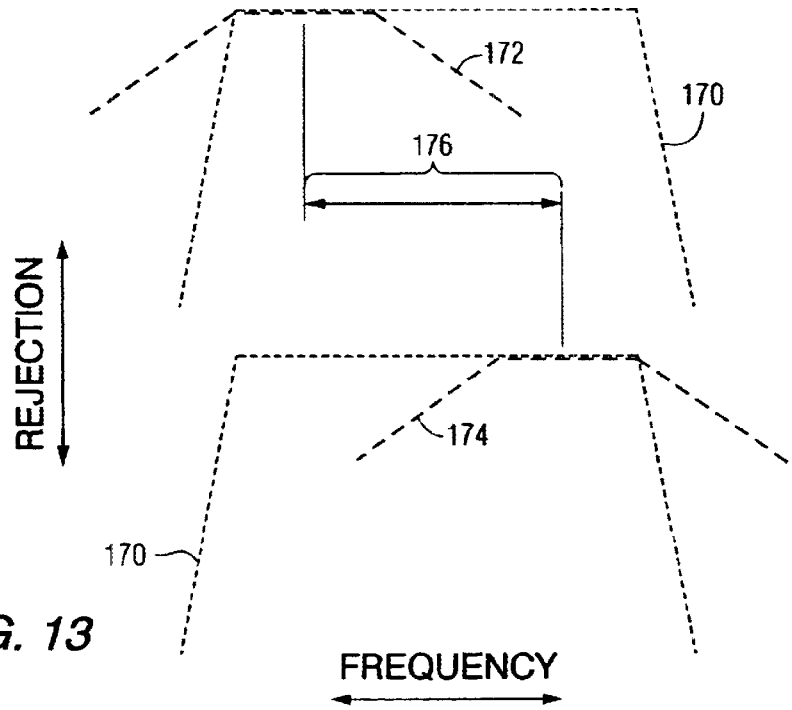
FIGS. 13 and 14 are graphs illustrating the properties of the tunable and fixed bandpass filters of the diplexer of FIG. 12.
Figure 14:
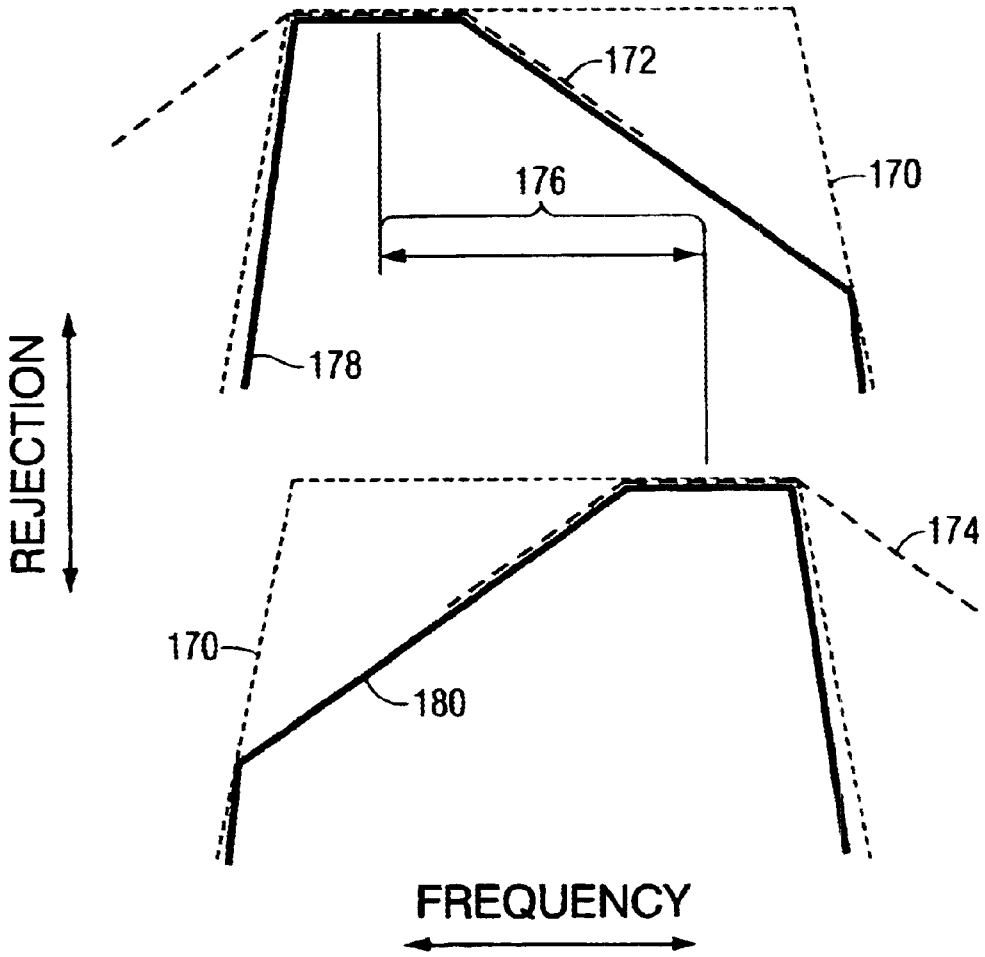

FIGS. 13 and 14 are graphs illustrating the properties of the tunable and fixed bandpass filters of the diplexer of FIG. 12. In one example, the fixed filter is a 6-pole wide bandwidth filter having the passband illustrated by curve 170 of FIG. 13. The tunable filter has only two poles for low insertion loss, and is narrow band, having a passband that can be tuned as illustrated by curves 174 and 176 of FIG. 13. This results in a filter tuning range illustrated by item 176 in FIG. 13. By using the combination of fixed an tunable filters, the losses are kept within the specification while the required isolation is achieved. Because the tunable filter is a narrow band filter, the superposition of the two filters will have the desired narrow band response as illustrated by curves 178 and 180 of FIG. 14. The overall response is essentially the bandwidth of the tunable filter.

One possible structure for the filters is a finline filter as described above having a rectangular waveguide cut in two halves according to the E-plane, plus an e-plane metal septum, with tunable varactors are mounted on the septum. Other structures for the filter, such as iris coupled or inductive post coupled waveguide cavity filters, or filters based on dielectric resonator cavities, etc. are also possible. Also, where the varactors are positioned inside the resonant cavity, other tunable capacitor structures can be used. Variation of the capacitance of the tunable capacitor affects the distribution of the electric filed inside the cavity, which in turn varies the resonant frequency.

The electronically tunable filters have low insertion loss, fast tuning speed, high power-handling capability, high IP3 and low cost in the microwave frequency range. Compared to the voltage-controlled semiconductor diode varactors, voltage-controlled tunable dielectric capacitors have higher Q factors, higher power-handling and higher IP3. Voltage-controlled tunable dielectric capacitors have a capacitance that varies approximately linearly with applied voltage and can achieve a wider range of capacitance values than is possible with semiconductor diode varactors. The tunable dielectric varactor based tunable diplexers of this invention have the merits of lower loss, higher power-handling, and higher IP3, especially at higher frequencies (>10 GHz).

The tunable dielectric varactors in the preferred embodiment of the present invention can include a low loss (Ba, Sr)$TiO_3$-based composite film. The typical Q factor of the tunable dielectric capacitors is 200 to 500 at 2 GHz, and 50 to 100 at 20 to 30 GHz, with a capacitance ratio ($C_{max}/C_{min}$), which is independent of frequency, of around 2. A wide range of capacitance of the tunable dielectric capacitors is variable, say 0.1 pF to 10 pF. The tuning speed of the tunable dielectric capacitor is less than 30 ns. The practical tuning speed is determined by auxiliary bias circuits.

Tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO-MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. patent applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; U.S. application Ser. No. 09/834,327 filed Apr. 13, 2001, entitled "Strain-Relieved Tunable Dielectric Thin Films"; and U.S. Provisional Application Ser. No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$-$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In one embodiment, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths. The high Q tunable dielectric capacitor utilizes low loss tunable substrates or films.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

This invention provides electronically tunable radio frequency diplexers particularly applicable to microwave radio applications. Compared to mechanically and magnetically tunable diplexers, electronically tunable diplexers have the most important advantage of fast tuning capability over wide band application. Because of this advantage, they can be used in the applications such as LMDS (local multipoint distribution service), PCS (personal communication system), frequency hopping, satellite communication, and radar systems. Electronically tunable radio frequency diplexers offer service providers flexibility and scalability never before accessible. A single diplexer solution enables radio manufacturers to replace several fixed diplexers covering adjacent frequencies. This versatility provides front end RF tunability in real time applications and decreases deployment and maintenance costs through software controls and reduced component count. Also, fixed diplexers need to be wide band so that their count does not exceed reasonable numbers to cover the desired frequency plan. Tunable diplexers, however, are narrow band, but they can cover even larger frequency band than fixed diplexers by tuning the filters over a wide range. Additionally, narrowband filters at the front end are appreciated from the systems point of view, because they provide better selectivity and help reduce interference from nearby transmitters. Narrowband electronically tunable radio frequency diplexers solutions are also possible for tunable channel selectivity.

The preferred embodiment of the invention uses a waveguide structure, which is tuned by voltage-controlled tunable dielectric capacitors placed inside the waveguide. In the filter structure, the tuning element is a voltage-controlled tunable capacitor, which is made from tunable dielectric material. Since the tunable capacitors show high Q, high IP3 (low inter-modulation distortion) and low cost, the tunable diplexer in the present invention has the advantage of low insertion loss, fast tuning speed, and high power handling. The present tunable dielectric material technology makes electronically tunable diplexers very promising in the contemporary communication system applications.

Compared to voltage-controlled semiconductor diode varactors, voltage-controlled tunable dielectric capacitors have higher Q factors, higher power-handling and higher IP3. Voltage-controlled tunable dielectric capacitors are employed in the diplexer structure to achieve the goal of this object. Also, tunable diplexers based on MEM technology can be used for these applications. Compared to semiconductor varactor based tunable diplexers, dielectric varactor based tunable diplexers have the merits of lower loss, higher power-handling, and higher IP3, especially at higher frequencies (>10 GHz). MEM based varactors can also be used for this purpose. They use different bias voltages to vary the electrostatic force between two parallel plates of the varactor and hence change its capacitance value. They show lower Q than dielectric varactors, but can be used successfully for low frequency applications.

At least two microelectromachanical variable capacitor topologies can be used, parallel plate and interdigital. In parallel plate structure, one of the plates is suspended at a distance from the other plate by suspension springs. This distance can vary in response to electrostatic force between two parallel plates induced by applied bias voltage. In the interdigital configuration, the effective area of the capacitor is varied by moving the fingers comprising the capacitor in and out and changing its capacitance value. MEM varactors have lower Q than their dielectric counterpart, especially at higher frequencies, but can be used in low frequency applications.

Accordingly, the present invention, by utilizing the unique application of high Q tunable capacitors, provides a high performance microwave electronically tunable diplexer. While the present invention has been described in terms of its preferred embodiments, it will be apparent to those skilled in the art that various changes can be made to the disclosed embodiments without departing from the scope of the invention as set forth in the following claims.

What is claimed is:

1. A diplexer comprising:

a first tunable bandpass filter including a first tunable capacitor and connected to a first port;

a second tunable bandpass filter including a second tunable capacitor and connected to a second port; and means for coupling the first bandpass filter and the second bandpass filter to a third port, wherein the means for coupling the first bandpass filter and the second bandpass filter to a third port comprises one of:

a circulator, a T-junction, and an orthomode transducer.

2. A diplexer according to claim 1, wherein the first and second tunable capacitors each comprise:

a tunable dielectric varactor.

3. A diplexer according to claim 1, wherein the first and second tunable capacitors each comprise:

a microelectromechanical variable capacitor.

4. A diplexer comprising:

a first tunable bandpass filter including a first tunable capacitor and connected to a first port;

a second tunable bandpass filter including a second tunable capacitor and connected to a second port; and means for coupling the first bandpass filter and the second bandpass filter to a third port, wherein:

the first tunable bandpass filter comprises a first plurality of resonators, wherein the first tunable capacitor couples a signal between two of the resonators in the first plurality of resonators; and the second tunable bandpass filter comprises a second plurality of resonators, wherein the second tunable capacitor couples a signal between two of the resonators in the second plurality of resonators.

5. A diplexer comprising:

a first tunable bandpass filter including a first tunable capacitor and connected to a first port;

a second tunable bandpass filter including a second tunable capacitor and connected to a second port; and means for coupling the first bandpass filter and the second bandpass filter to a third port, wherein the first tunable bandpass filter comprises:

a first waveguide; and a first septum position along an axis of the first waveguide; and wherein the first tunable capacitor is mounted on the septum.

6. A diplexer according to claim 5, wherein the first tunable capacitor comprises:

a substrate having a first dielectric constant and having generally a planar surface;

a tunable dielectric layer positioned on the generally planar surface of the substrate, the tunable dielectric layer having a second dielectric constant greater than said first dielectric constant; and first and second electrodes positioned on a surface of the tunable dielectric layer opposite the generally planar surface of the substrate, said first and second electrodes being separated to form a gap therebetween.

7. A diplexer according to claim 6, wherein the first tunable capacitor further comprises:

an insulating material in said gap.

8. A diplexer according to claim 6, wherein the tunable dielectric layer in the first tunable dielectric varactor has a permittivity in a range from about 20 to about 2000, and a tunability in a range from about 10% to about 80% at a bias voltage of about 10 V/$\mu$m.

9. A diplexer according to claim 5, wherein the second tunable bandpass filter comprises:

a second waveguide; and a second septum position along an axis of the second waveguide; and wherein the second tunable capacitor is mounted on the second septum.

10. A diplexer according to claim 9, wherein the second tunable capacitor comprises:

a substrate having a first dielectric constant and having generally a planar surface;

a tunable dielectric layer positioned on the generally planar surface of the substrate, the tunable dielectric layer having a second dielectric constant greater than said first dielectric constant; and first and second electrodes positioned on a surface of the tunable dielectric layer opposite the generally planar surface of the substrate, said first and second electrodes being separated to form a gap therebetween.

11. A diplexer according to claim 10, wherein the second tunable capacitor further comprises:

an insulating material in said gap.

12. A diplexer according to claim 9, wherein the tunable dielectric layer in the second tunable capacitor has a permittivity in a range from about 20 to about 2000, and a tunability in a range from about 10% to about 80% at a bias voltage of about 10 V/$\mu$m.

13. A diplexer according to claim 10, further comprising:

a first fixed bandpass filter connected between the first tunable bandpass and the means for coupling the first bandpass filter and the second bandpass filter to a third port; and a second fixed bandpass filter connected between the second tunable bandpass and the means for coupling the first bandpass filter and the second bandpass filter to a third port.

14. A diplexer according to claim 13, wherein:

each of the first and second fixed bandpass filters has a larger passband than each of the first and second tunable filters.

15. A diplexer according to claim 13, wherein:

the first tunable filter has a passband that can be tuned within a passband of the first fixed bandpass filter; and the second tunable filter has a passband that can be tuned within a passband of the second fixed bandpass filter.

16. A diplexer comprising:

a first tunable bandpass filter including a first tunable capacitor and connected to a first port;

a second tunable bandpass filter including a second tunable capacitor and connected to a second port; and means for coupling the first bandpass filter and the second bandpass filter to a third port, wherein:

the first tunable bandpass filter comprises a first plurality of resonators, wherein the first tunable capacitor is positioned within one of the resonators in the first plurality of resonators; and the second tunable bandpass filter comprises a second plurality of resonators, wherein the second tunable capacitor is positioned within one of the resonators in the second plurality of resonators.

17. A diplexer according to claim 16, wherein the first and second tunable capacitors each comprise: a microelectromechanical variable capacitor.

18. A diplexer according to claim 16, wherein the first and second tunable capacitors each comprise:

a tunable dielectric varactor.

* * * * *